US009714395B2

(12) United States Patent
Iwai

(10) Patent No.: US 9,714,395 B2
(45) Date of Patent: Jul. 25, 2017

(54) LUBRICANT OIL COMPOSITION

(71) Applicant: IDEMITSU KOSAN CO., LTD., Chiyoda-ku (JP)

(72) Inventor: Toshiaki Iwai, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/764,373

(22) PCT Filed: Mar. 13, 2014

(86) PCT No.: PCT/JP2014/056640

§ 371 (c)(1),
(2) Date: Jul. 29, 2015

(87) PCT Pub. No.: WO2014/142231

PCT Pub. Date: Sep. 18, 2014

(65) Prior Publication Data

US 2015/0368582 A1 Dec. 24, 2015

(30) Foreign Application Priority Data

Mar. 15, 2013 (JP) ..... 2013-054118

(51) Int. Cl.
*C10M 141/10* (2006.01)
*C10M 163/00* (2006.01)
*C10M 169/04* (2006.01)

(52) U.S. Cl.
CPC ..... *C10M 141/10* (2013.01); *C10M 163/00* (2013.01); *C10M 169/045* (2013.01); *C10M 2203/1025* (2013.01); *C10M 2207/026* (2013.01); *C10M 2207/028* (2013.01); *C10M 2207/046* (2013.01); *C10M 2207/144* (2013.01); *C10M 2207/262* (2013.01); *C10M 2207/289* (2013.01); *C10M 2215/064* (2013.01); *C10M 2215/28* (2013.01); *C10M 2219/046* (2013.01); *C10M 2219/08* (2013.01); *C10M 2219/106* (2013.01); *C10M 2223/045* (2013.01); *C10M 2223/047* (2013.01); *C10M 2223/049* (2013.01); *C10M 2229/02* (2013.01); *C10N 2220/022* (2013.01); *C10N 2230/06* (2013.01); *C10N 2230/12* (2013.01); *C10N 2230/52* (2013.01); *C10N 2230/54* (2013.01); *C10N 2240/04* (2013.01); *C10N 2240/042* (2013.01); *C10N 2240/045* (2013.01)

(58) Field of Classification Search
CPC ..... C10M 141/10; C10M 2219/106; C10M 2223/045; C10M 2223/047; C10M 163/00; C10M 169/045; C10M 2203/1025; C10M 2207/026; C10M 2207/028; C10M 2207/46; C10M 2207/144; C10M 2207/262; C10M 2207/289; C10M 2215/064; C10M 2215/28; C10M 2219/046; C10M 2219/08; C10M 2223/049; C10M 2229/02; C10N 2230/42; C10N 2240/045; C10N 2220/022; C10N 2230/06; C10N 2230/12; C10N 2230/52; C10N 2230/54; C10N 2240/04; C10N 2240/042
USPC ..... 508/272, 442, 391, 502, 586
See application file for complete search history.

(56) References Cited

U.S. PATENT DOCUMENTS

| | | | | |
|---|---|---|---|---|
| 2,750,342 | A * | 6/1956 | Mikeska | C07F 9/091 508/432 |
| 4,511,480 | A | 4/1985 | Outlaw et al. | |
| 6,426,323 | B1 * | 7/2002 | Sato | C10M 137/10 508/371 |
| 2004/0204325 | A1 | 10/2004 | Takahashi | |
| 2007/0155632 | A1 * | 7/2007 | Hata | C10M 169/04 508/258 |
| 2009/0312211 | A1 * | 12/2009 | Yamada | C10M 143/02 508/564 |
| 2010/0105588 | A1 | 4/2010 | Ichihashi | |
| 2010/0126461 | A1 | 5/2010 | Yamasaki et al. | |
| 2010/0317551 | A1 | 12/2010 | Iwai | |
| 2011/0053816 | A1 | 3/2011 | Narita | |
| 2012/0277134 | A1 * | 11/2012 | Deshimaru | C10M 141/10 508/272 |

FOREIGN PATENT DOCUMENTS

| | | |
|---|---|---|
| CN | 101495607 | 7/2009 |
| EP | 0 382 242 | 8/1990 |
| EP | 0 391 649 | 10/1990 |
| EP | 2 145 941 | 1/2010 |

(Continued)

OTHER PUBLICATIONS

International Search Report issued Jun. 10, 2014, in PCT/JP2014/056640 filed Mar. 13, 2014.
Office Action issued on Jul. 26, 2016 in Japanese Patent Application No. 2013-054118 (with English language translation).
European Search Report issued Sep. 9, 2016, in European Patent Application No. 14764912.3.
Office Action issued Mar. 6, 2017 in Chinese Patent Application No. 201480015100.X, filed Mar. 13, 2014 (with English translation).

*Primary Examiner* — James Goloboy
(74) *Attorney, Agent, or Firm* — Oblon, McClelland, Maier & Neustadt, L.L.P.

(57) ABSTRACT

A lubricating oil composition is provided by blending a base oil and an additive, the additive including (a) at least one of an alkaline earth metal sulfonate, an alkaline earth metal salicylate and an alkaline earth metal phenate, (b) a sulfur-containing phosphorus compound, and (c) a thiadiazole compound. A product ((c)×P) of a mass (mass %) of the component (c) and a mass (mass ppm) of a phosphorus element in the component (b) in the composition is in a range from 1 to 50.

12 Claims, No Drawings

(56) References Cited

FOREIGN PATENT DOCUMENTS

| | | | |
|---|---|---|---|
| JP | 59-40044 | A | 3/1984 |
| JP | 8-253785 | A | 10/1996 |
| JP | 10-183154 | A | 7/1998 |
| JP | 2000-193070 | A | 7/2000 |
| JP | 2001-49280 | A | 2/2001 |
| JP | 2001-140987 | A | 5/2001 |
| JP | 2002-105476 | A | 4/2002 |
| JP | 2002-371291 | A | 12/2002 |
| JP | 2003-138285 | A | 5/2003 |
| JP | 2005-147282 | A | 6/2005 |
| JP | 2007-126543 | A | 5/2007 |
| JP | 2008-222904 | A | 9/2008 |
| JP | 4117043 | B2 | 7/2009 |
| JP | 4377505 | B2 | 12/2009 |
| JP | 2010-189479 | A | 9/2010 |
| JP | 2011-6705 | A | 1/2011 |
| WO | WO 2008/133327 | A1 | 11/2008 |
| WO | WO 2009/101847 | A1 | 8/2009 |

* cited by examiner

LUBRICANT OIL COMPOSITION

CROSS-REFERENCE TO RELATED APPLICATIONS

This application is a National Stage of PCT/JP2014/056640, which was filed on Mar. 13, 2014. This application is based upon and claims the benefit of priority to Japanese Application No. 2013-054118, which was filed on Mar. 15, 2013.

TECHNICAL FIELD

The present invention relates to a lubricating oil composition suitable for a continuously variable transmission.

BACKGROUND ART

In order to address the great issue of improving fuel efficiency in view of recently growing concern on global environment, an increasing number of automobiles have come to be attached with a continuously variable transmission (CVT), which are more efficient than a multi-stage automatic transmission (AT). The CVT often employs a metal push-belt, and is installed in a wide variety of vehicles of 0.6 to 3.5-litter displacement. A chain CVT, which is considered to exhibit higher efficiency, has come to be used in these days. Since the power is transmitted in these CVTs via a friction between a pulley and a belt or between a pulley and a chain, a large force is applied to force one of the components to the other in order to restrain a slippage between the components. CVTF (CVT Fluid) is used for lubrication between the belt and the pulley or between the chain and the pulley. Since reduction in a force for forcing one of these components to the other results in improvement in fuel efficiency, a high intermetal friction coefficient is required of the CVTF. In addition, in order to further improve the fuel efficiency, a mechanism for controlling a slippage in a lockup clutch installed with a torque converter is often used. Accordingly, most of the CVTF exhibits friction characteristics to a wet clutch. However, as the intermetal friction coefficient of the CVTF increases, vibrations and noises often occur between the pulley and the belt or between the pulley and the chain. In order to restrain the occurrence of the vibrations and noises, the CVTF is also demanded to exhibit excellent intermetal friction-coefficient/slipping-velocity characteristics (sometimes referred to as "intermetal μ-V characteristics" hereinafter) in addition to the high intermetal friction coefficient.

For instance, Patent Literature 1 discloses a combination of an alkaline earth metal salt with a high base number and an alkaline earth metal salt with a low base number, in which an imide compound and a phosphorus compound are blended, thereby enhancing the intermetal friction coefficient to improve the friction characteristics for a wet clutch. Patent Literature 2 discloses that an alkaline earth metal salt, a boron-containing succinimide, a triazole compound, an (alkyl)aryl phosphite, and an imide- or amine-friction modifier are blended to increase a transmission torque volume and to improve an abrasion resistance and friction characteristics to a wet clutch. Patent Literature 3 discloses that a phosphorus compound and succinimide are used to enhance the intermetal friction coefficient and restrain clogging of a wet clutch. Patent Literature 4 discloses that an organic acid metal salt, phosphorus compound, and succinimide are combined to enhance the intermetal friction coefficient and restrain clogging of a wet clutch. Patent Literature 5 discloses a compound for restraining noises. Specifically, a compound is provided by a combination of an alkaline earth metal sulfonate with a relatively low base number and a phosphate, in which a friction modifier including a sarcosine derivative and a reaction product of a carboxylic acid and amine are blended, thereby restraining a scratch noise.

CITATION LIST

Patent Literature(s)

Patent Literature 1: JP-B-4377505
Patent Literature 2: JP-A-2007-126543
Patent Literature 3: JP-A-2010-189479
Patent Literature 4: JP-A-2011-006705
Patent Literature 5: JP-B-4117043

SUMMARY OF THE INVENTION

Problems to be Solved by the Invention

All of the techniques disclosed in the above Patent Literatures 1 to 5, which relate to the intermetal friction coefficient and friction characteristics to a wet clutch, also address a matter of abrasion resistance.

However, it has come to be known that an additive that improves abrasion resistance tends to increase copper elution properties. It is difficult to apply a CVTF with high copper elution properties to a CVT using a metallic belt or a chain.

An object of the invention is to provide a lubricating oil composition that is high in abrasion resistance and low in copper elution properties.

Means for Solving the Problems

In order to solve the above-mentioned problems, according to an aspect(s) of the invention, there is provided a lubricating oil composition described below.

(1) A lubricating oil composition containing: a base oil; and an additive, the additive including: (a) at least one of an alkaline earth metal sulfonate, an alkaline earth metal salicylate and an alkaline earth metal phenate; (b) a sulfur-containing phosphorus compound; and (c) a thiadiazole compound, in which a product ((c)×P) of a mass (mass %) of the component (c) and a mass (mass ppm) of a phosphorus element in the component (b) in the composition is in a range from 1 to 50.

(2) The lubricating oil composition according to the above aspect of the invention, in which the component (a) is at least one of a Ca salt and a Mg salt.

(3) The lubricating oil composition according to the above aspect(s) of the invention, in which the component (b) is at least one of a sulfur-containing phosphate and a sulfur-containing phosphite.

(4) The lubricating oil composition according to the above aspect(s) of the invention, in which a base number of the component (a) measured by a perchloric acid method is in a range from 10 mgKOH/g to 500 mgKOH/g.

(5) The lubricating oil composition according to the above aspect(s) of the invention, in which a mass of the alkaline earth metal in the component (a) is in a range from 200 mass ppm to 1000 mass ppm based on a total amount of the composition.

(6) The lubricating oil composition according to the above aspect(s) of the invention, in which a content of phosphorus element in the component (b) is in a range from 50 mass ppm to 300 mass ppm based on the total amount of the composition.

(7) The lubricating oil composition according to the above aspect(s) of the invention, in which the lubricating oil composition is suitable for use in an automatic transmission.

(8) The lubricating oil composition according to the above aspect(s) of the invention, in which the automatic transmission is a continuously variable transmission.

(9) The lubricating oil composition according to the above aspect(s) of the invention, in which the continuously variable transmission is a metal-belt continuously variable transmission or a chain continuously variable transmission.

The lubricating oil composition of the above aspect(s) of the invention is excellent in abrasion resistance and is low in copper elution properties. Accordingly, when the lubricating oil composition is used as, for instance, a CVTF, abrasion resistance that affects power transmission performance of a metal-belt CVT or a chain CVT can be maintained at a high level and can be kept for a long time.

DESCRIPTION OF EMBODIMENT(S)

A lubricating oil composition according to an exemplary embodiment (sometimes simply referred to as "the present composition" hereinafter) is provided by blending (or contains) a base oil and an additive, the additive including: (a) at least one of an alkaline earth metal sulfonate, an alkaline earth metal salicylate and an alkaline earth metal phenate, (b) a sulfur-containing phosphorus compound, and (c) a thiadiazole compound. An exemplary embodiment of the invention will be described below in detail.

Base Oil

The base oil of the present composition is not specifically limited but any oil including a mineral oil and synthetic oil can be used as long as the oil is usable for an ATF (AT Fluid) and CVTF (CVT Fluid).

Examples of the mineral oil include a paraffinic mineral oil, an intermediate mineral oil and a naphthenic mineral oil. More specifically, a light neutral oil, a medium neutral oil, a heavy neutral oil, bright stock and the like can be used, among which a paraffinic mineral oil is particularly preferable in terms of viscosity/temperature characteristics. On the other hand, examples of the synthetic oil are polybutene, polyolefin (alpha-olefin homopolymer or copolymer such as ethylene-alpha-olefin copolymer), various esters (such as polyol ester, diacid ester and phosphate ester), various ethers (such as polyphenylether), polyoxy-alkylene glycol, alkylbenzene, alkyl naphthalene and the like. Among the above, polyolefin and polyol ester are particularly preferable in terms of lubricity.

In the exemplary embodiment, one of the above mineral oils may be singularly used or a combination of two or more thereof may be used as the base oil. In addition, one of the above synthetic oils may be singularly used or a combination of two or more thereof may be used. Further, a combination of at least one of the above mineral oils and at least one of the above synthetic oils may be used.

Component (a)

The component (a) of the present composition is at least one of alkaline earth metal sulfonate, alkaline earth metal salicylate and alkaline earth metal phenate. The component (a) may be a single one of the above alkaline earth metal salts or a combination of two or more thereof.

Conventionally, such alkaline earth metal salts are added as a metal detergent to lubricating oil for an internal combustion engine. However, in the exemplary embodiment, the alkaline earth metal salts also serve as an antiwear agent.

In the three alkaline earth metal salts, alkaline earth metal sulfonate is especially preferable in terms of abrasion resistance. The alkaline earth metal sulfonate is preferably an alkylbenzene sulfonate with an alkyl group having 1 to 50 carbon atoms. The alkaline earth metal is preferably Ca and Mg in terms of improvement in abrasion resistance, especially preferably Ca.

In other words, Ca sulfonate is the most preferable.

The above component (a) is preferably provided by hydroxylating an alkaline earth metal or overbasing an alkaline earth metal with a carbonate. Specifically, the base number of the component (a) measured by a perchloric acid method is preferably in a range from 10 mgKOH/g to 500 mgKOH/g, preferably in a range from 50 mgKOH/g to 400 mgKOH/g. With the base number of the component (a) in the above range, the intermetal μ-V characteristics can be further improved.

Further, the content of the component (a) is preferably in a range from 200 mass ppm to 1000 mass ppm in terms of alkaline earth metal based on the total amount of the composition, more preferably in a range from 250 mass ppm to 600 mass ppm, further preferably in a range from 300 mass ppm to 500 mass ppm. With the content of the component (a) in the above range, the intermetal friction coefficient can be appropriately improved and excellent intermetal μ-V characteristics can be obtained. Further, abrasion resistance is also improved.

Component (b)

The component (b) of the present composition is a sulfur-containing phosphorus compound. The component (b) is especially preferably a phosphite or a phosphate containing sulfur in a molecule as represented by the formulae (1) and (2) below in terms of abrasion resistance and of improvement in intermetal friction coefficient and intermetal μ-V characteristics. One of the above phosphite and phosphate may be singularly used or a combination of two or more thereof may be used.

Chemical Formula 1

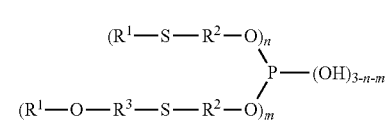

(1)

Chemical Formula 2

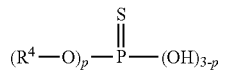

(2)

In the formula (1), $R^1$ represents a hydrocarbon group having 6 to 20 carbon atoms. Specific examples of the hydrocarbon group include an alkyl group such as hexyl groups, heptyl groups, octyl groups, nonyl groups, decyl groups undecyl groups, dodecyl groups, tridecyl groups, tetradecyl groups, pentadecyl groups and hexadecyl groups, a cycloalkyl group such as a cyclohexyl group, methylcyclohexyl groups, ethylcyclohexyl groups, propylcycloalkyl groups and dimethylcycloalkyl groups, an aryl group such as a phenyl group, methylphenyl groups, ethylphenyl groups, propylphenyl groups, butylphenyl groups, pentylphenyl groups, hexylphenyl groups, heptylphenyl groups, octylphenyl groups, nonylphenyl groups, decylphenyl groups and naphthyl groups, and an arylalkyl group such as a benzyl group, phenylethyl groups, methylbenzyl groups, phenylpropyl groups and phenylbutyl groups.

Among the above, alkyl groups having 8 to 16 carbon atoms are preferable in terms of improvement in the intermetal friction coefficient and intermetal μ-V characteristics.

In the formula (1), m and n are one of 0, 1 and 2, where m and n are not simultaneously 0, and the sum of m and n is preferably 2 or less in terms of improvement in the intermetal friction coefficient and the intermetal μ-V characteristics.

In the formula (1), $R^2$ and $R^3$ each independently represent an alkylene group having 1 to 6 carbon atoms, where the number of carbon atoms is preferably 1 or 2 in terms of improvement in the intermetal friction coefficient and the intermetal μ-V characteristics.

Specific examples of the phosphite in the formula (1) are mono(octylthiolethyl)phosphite, mono(dodecylthioethyl) phosphite, mono(hexadecylthioethyl)phosphite, di(octylthioethyl)phosphite, di(dodecylthioethyl)phosphite, di(hexadecylthioethyl)phosphite, mono(octyloxythioethyl) phosphite, mono(dodecyloxythioethyl)phosphite, mono (hexadecyloxythioethyl)phosphite, di(octyloxythioethyl) phosphite, di(dodecyloxythioethyl)phosphite, and di(hexadecyloxythioethyl)phosphite.

In the above formula (2), $R^4$ represents a hydrocarbon group having 2 to 20 carbon atoms, where $R^4$ is preferably the same as $R^1$ in the above formula (1) in terms of improvement in the intermetal friction coefficient and the intermetal μ-V characteristics.

In the formula (2), p represents an integer in a range from 0 to 3, preferably 2 or 3, and more preferably 3.

Specific examples of the phosphate in the above formula (2) are tributyldithiophosphate, trioctylthiophate, tridecylthiophate, tridodecylthiophosphate, trihexadecylthiophosphate, trioctadecylthiophosphate, triphenylthiophosphate, tricresylthiophosphate, tributylphenylthiophosphate, trihexylphenylthiophosphate, trioctylphenylthiophosphate, and tridecylphenylthiophosphate.

The content of the component (b) is preferably in a range from 50 mass ppm to 300 mass ppm in terms of phosphorus based on the total amount of the composition for the purpose of sufficiently enhancing the intermetal friction coefficient and obtaining favorable intermetal μ-V characteristics. Further, in order to further enhance the intermetal friction coefficient and intermetal μ-V characteristics, the content of the component (b) is preferably in a range from 100 mass ppm to 270 mass ppm in terms of phosphorus based on the total amount of the composition, more preferably in a range from 150 mass ppm to 250 mass ppm.

It should be noted that a non-sulfur-containing phosphate and/or a non-sulfur-containing phosphite or an amine thereof may be used in combination with the sulfur-containing phosphorus compound of the component (b) to provide the phosphorus compound, as long as the intermetal friction coefficient or the intermetal characteristics are not significantly deteriorated.

Component (c)

The component (c) of the present composition is a thiadiazole compound. Preferable examples of the thiadiazole compound are 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis-(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole and 4,5-bis-(1,1,3,3-tetramethylbutyldithio)-1,2,3-thiadiazole.

In terms of balance between effect as an extreme pressure agent and economic efficiency or the like, the content of the component (c) is preferably in a range from 0.02 mass % to 2 mass % based on the total amount of the composition, more preferably in a range from 0.05 mass % to 1.5 mass %.

A product ((c)×P) of the mass (mass %) of the component (c) and the mass (mass ppm) of the phosphorus element in the component (b) in the present composition is in a range from 1 to 50. The lower limit of the product is preferably 5 or more, more preferably 10 or more.

When the product ((c)×P) is in the range from 1 to 50, the copper elution properties can be effectively restrained.

The above-described present composition exhibits excellent abrasion resistance and restrained copper elution properties. Accordingly, the present composition, which is effective for maintaining the ride quality in an automobile installed with a metal-belt CVT or a chain CVT, is of great use as a CVT fluid (CVTF). It should be understood that the present composition is also suitable for use as a lubricating oil for a multistage automatic transmission (ATF).

Other Additives

The present composition may be added as necessary with other additives such as an antioxidant, a viscosity index improver, an ashless dispersant, a copper deactivator, a rust inhibitor, a friction modifier and an antifoaming agent as long as advantages of the exemplary embodiment are not hampered.

Examples of the antioxidant are amine antioxidants (diphenylamines, naphthylamines), phenolic antioxidants and sulfuric antioxidants. The content of the antioxidant is preferably approximately in a range from 0.05 mass % to 7 mass %.

Examples of the viscosity index improver are polymethacrylate, dispersed polymethacrylate, an olefin-based copolymer (such as an ethylene-propylene copolymer), a dispersed olefin-based copolymer, a styrene-based copolymer (such as a styrene-diene copolymer and a styrene-isoprene copolymer) and the like. The content of the viscosity index improver is preferably approximately in a range from about 0.5 mass % to 15 mass % based on the total amount of the composition in view of blending effect.

Examples of the ashless dispersant are succinimide compounds, boron-based imide compounds and acid amide compounds. The content of the ashless dispersant is preferably approximately in a range from 0.1 mass % to 20 mass % based on the total amount of the composition.

Examples of the copper deactivator are benzotriazole, benzotriazole derivatives, triazole, triazole derivatives, imidazole and imidazole derivatives. The content of the copper deactivator is approximately in a range from 0.01 mass % to 5 mass % based on the total amount of the composition.

Examples of the rust inhibitor are fatty acids, half-esters of alkenyl-succinic acid, fatty acid soaps, alkyl sulfonates, polyalcohol fatty acid esters, fatty acid amides, oxidized paraffins, and alkyl-polyoxyethylene ethers. The content of the rust inhibitor is preferably approximately in a range from 0.01 mass % to 3 mass % based on the total amount of the composition.

Examples of the friction modifier include carboxylic acid, carboxylate ester, fat and oil, carboxylic amide and sarcosine derivative. The content of the friction modifier is preferably approximately in a range from 0.01 mass % to 5 mass %.

Examples of the antifoaming agent are silicone compounds, fluorosilicone compounds, and ester compounds. The content of the antifoaming agent is preferably approximately in a range from 0.01 mass % to 5 mass % based on the total amount of the composition.

EXAMPLES

The exemplary embodiment will be further described in detail below with reference to Examples and Comparatives, which by no means limit the scope of the invention. The properties and performance of the lubricating oil composition (sample oil) in each of Examples and Comparatives were obtained according to the methods described below.

(1) Kinematic Viscosity

Measurement was conducted based on JIS K 2283.

(2) Calcium and Phosphorus Content

Measurement was conducted based on JPI-5S-38-92.

(3) Nitrogen Content

Measurement was conducted based on JIS K2609.

(4) Sulfur Content

Measurement was conducted based on JIS K 2541.

(5) Acid Number and Base Number

Measurement was conducted based on JIS K 2501.

The base number of the component (a) was obtained according to a perchloric acid method.

The base number of the sample oil was obtained according to each of hydrochloric acid method and perchloric acid method.

(6) Copper Elution Amount

A copper elution amount (mass ppm) after ISOT test (170 degrees C., 96 hours) was measured according to JPI-5S-38-92.

(7) Maximum Loading Capacity Test (Shell EP Test)

A test was conducted at a rotational speed of 1,800 rpm and at room temperature according to ASTM D2783. A load wear index (LWI) was calculated from a last non-seizure load (LNL) and a weld load (WL). The unit of all of these values is "N." The larger this value is, the better a load resistance is.

(8) Wear Resistance Test (Shell Wear Test)

A test was conducted at a load of 392N, a rotational speed of 1,200 rpm and an oil temperature of 80 degrees C. for testing time of 60 minutes according to ASTM D2783. An average wear diameter (mm) was calculated from wear diameters of three half inch balls.

Examples 1-4, Comparatives 1-7

The lubricating base oil and various additives below were used to prepare transmission lubricating oil compositions (sample oils) according to blend composition as shown in Table 1. The properties and performance of the sample oils were evaluated according to the above described methods. The results are shown in Table 1.

TABLE 1

| | | | | Ex. 1 | Ex. 2 | Ex. 3 | Ex. 4 | Comp. 1 | Comp. 2 |
|---|---|---|---|---|---|---|---|---|---|
| Blend Composition (mass %) | Base Oil | | | 90.31 | 90.42 | 91.05 | 90.95 | 90.27 | 90.41 |
| | Antioxidant 1 | | | 0.50 | 0.50 | 0.30 | 0.50 | 0.50 | 0.50 |
| | Antioxidant 2 | | | 1.00 | 1.00 | 1.00 | 1.00 | 1.00 | 1.00 |
| | Ca Sulfonate 1 Component (a) | | | 3.00 | 3.00 | — | — | — | — |
| | Ca Sulfonate 2 Component (a) | | | 0.34 | 0.23 | 3.10 | — | 0.23 | 0.34 |
| | Ca Sulfonate 3 Component (a) | | | — | — | — | — | — | — |
| | Ca Salicylate Component (a) | | | — | — | — | 3.00 | — | — |
| | Ca Phenate component (a) | | | — | — | — | — | 4.00 | 3.00 |
| | B-Type Imide | | | 2.00 | 2.00 | 2.00 | 2.00 | 2.00 | 2.00 |
| | Sulfur-Containing Phosphorus Compound Component (b) | | | 2.30 | 2.30 | 2.00 | 2.00 | 1.50 | 2.30 |
| | DBDS | | | 0.15 | 0.15 | 0.15 | 0.15 | 0.20 | 0.15 |
| | Glyceride | | | 0.10 | 0.10 | 0.10 | 0.10 | 0.10 | 0.10 |
| | Sulfuric Extreme Pressure Agent Component (c) | | | 0.10 | 0.10 | 0.10 | 0.10 | — | — |
| | Antifoaming Agent | | | 0.20 | 0.20 | 0.20 | 0.20 | 0.20 | 0.20 |
| | Total | | | 100.0 | 100.0 | 100.0 | 100.0 | 100.0 | 100.0 |
| Properties | Kinematic Viscosity | @40° C. | $mm^2/s$ | 24.4 | 24.4 | 32.4 | 30.1 | 25.2 | 24.4 |
| | | @100° C. | $mm^2s$ | 5.47 | 5.05 | 7.34 | 7.16 | 5.18 | 5.05 |
| | Viscosity Index | | — | 140 | 139 | 203 | 215 | 140 | 138 |
| | Acid Number | | mgKOH/g | 0.51 | 0.50 | 0.62 | 1.00 | 0.33 | 0.47 |
| | Base Number | Hydrochloric Acid Method | mgKOH/g | 0.92 | 0.88 | 1.45 | 2.27 | 0.91 | 0.94 |
| | | Perchloric Acid Method | mgKOH/g | 4.80 | 4.49 | 3.65 | 4.63 | 4.34 | 4.85 |
| | Chemical Component | P | mass ppm | 290 | 280 | 200 | 200 | 190 | 290 |
| | | N | mass % | 0.14 | 0.14 | 0.14 | 0.10 | 0.13 | 0.13 |
| | | Ca | mass ppm | 450 | 300 | 500 | 630 | 300 | 450 |
| | | S | mass ppm | 0.12 | 0.12 | 0.12 | 0.12 | 0.09 | 0.08 |
| | Component (c) × P | | — | 29.00 | 28.00 | 20.00 | 20.00 | 0.00 | 0.00 |
| Performance | Shell EP | LNL | N | 618 | 785 | 785 | 618 | 392 | 785 |
| | | WL | N | 1961 | 1961 | 1961 | 1961 | 1961 | 1961 |
| | | LWI | N | 289 | 381 | 356 | 301 | 221 | 349 |
| | Shell Wear | | mm | 0.61 | 0.51 | 0.46 | 0.52 | 0.80 | 0.81 |
| | Copper Elution Amount | | mass ppm | 59 | 33 | 40 | 7 | 447 | 318 |

| | | Comp. 3 | Comp. 4 | Comp. 5 | Comp. 6 | Comp. 7 |
|---|---|---|---|---|---|---|
| Blend Composition (mass %) | Base Oil | 90.00 | 90.28 | 90.21 | 88.90 | 91.60 |
| | Antioxidant 1 | 0.50 | 0.50 | 0.50 | 0.50 | 0.50 |
| | Antioxidant 2 | 1.00 | 1.00 | 1.00 | 1.00 | 1.00 |
| | Ca Sulfonate 1 Component (a) | — | — | — | — | — |
| | Ca Sulfonate 2 Component (a) | 0.37 | 0.34 | 0.19 | — | — |
| | Ca Sulfonate 3 Component (a) | — | — | — | — | 0.30 |

TABLE 1-continued

| | | | | | | | | |
|---|---|---|---|---|---|---|---|---|
| | Ca Salicylate Component (a) | | | — | — | — | 3.00 | — |
| | Ca Phenate component (a) | | | 4.00 | 3.00 | 4.00 | — | — |
| | B-Type Imide | | | 2.00 | 2.00 | 2.00 | 2.00 | 2.00 |
| | Sulfur-Containing Phosphorus Compound Component (b) | | | 1.50 | 2.30 | 1.50 | 4.00 | 4.00 |
| | DBDS | | | 0.33 | 0.28 | 0.20 | 0.20 | 0.20 |
| | Glyceride | | | 0.10 | 0.10 | 0.10 | 0.10 | 0.10 |
| | Sulfuric Extreme Pressure Agent Component (c) | | | — | — | 0.10 | 0.10 | 0.10 |
| | Antifoaming Agent | | | 0.20 | 0.20 | 0.20 | 0.20 | 0.20 |
| | Total | | | 100.0 | 100.0 | 100.0 | 100.0 | 100.0 |
| Properties | Kinematic Viscosity | @40° C. | $mm^2/s$ | 25.3 | 24.4 | 25.3 | 28.2 | 27.2 |
| | | @100° C. | $mm^2s$ | 5.19 | 5.04 | 5.20 | 7.01 | 6.74 |
| | Viscosity Index | | — | 141 | 139 | 141 | 227 | 222 |
| | Acid Number | | mgKOH/g | 0.31 | 0.46 | 0.35 | 0.88 | 0.79 |
| | Base Number | Hydrochloric Acid Method | mgKOH/g | 1.09 | 0.94 | 0.88 | 1.24 | 0.81 |
| | | Perchloric Acid Method | mgKOH/g | 4.83 | 4.90 | 4.20 | 5.33 | 4.31 |
| | Chemical Component | P | mass ppm | 190 | 290 | 100 | 600 | 600 |
| | | N | mass % | 0.13 | 0.13 | 0.14 | 0.13 | 0.09 |
| | | Ca | mass ppm | 490 | 450 | 250 | 700 | 500 |
| | | S | mass ppm | 0.13 | 0.11 | 0.12 | 0.18 | 0.18 |
| | Component (c) × P | | — | 0.00 | 0.00 | 19.00 | 60.00 | 60.00 |
| Performance | Shell EP | LNL | N | 785 | 785 | 981 | 490 | 490 |
| | | WL | N | 1961 | 1961 | 1961 | 1961 | 1961 |
| | | LWI | N | 350 | 430 | 418 | 292 | 252 |
| | Shell Wear | | mm | 0.81 | 0.76 | 0.75 | 0.60 | 0.51 |
| | Copper Elution Amount | | mass ppm | 555 | 522 | 96 | 220 | 205 |

The details of the base oil and the additives used in the above Table 1 are as follows:

(1) Base oil: Paraffinic base oil (a kinematic viscosity at 40 degrees C. of 20 $mm^2/s$ and a kinematic viscosity at 100 degrees C. of 4.3 $mm^2/s$)

(2) Antioxidant 1: 2,6-di-tert-butyl-p-cresol (3) Antioxidant 2: Diphenylamine-base antioxidant (4) Ca sulfonate 1: Ca sulfonate having a base number measured by a perchloric acid method of 200 mgKOH/g, component (a)

(5) Ca sulfonate 2: Ca sulfonate having a base number measured by perchloric acid method of 300 mgKOH/g, component (a)

(6) Ca sulfonate 3: Ca sulfonate having a base number measured by perchloric acid method of 400 mgKOH/g, component (a)

(7) Ca salicylate: Ca salicylate having a base number measured by a perchloric acid method of 100 mgKOH/g, component (a)

(8) Ca phenate: Ca phenate having a base number measured by a perchloric acid method of 200 mgKOH/g, component (a)

(9) B-type imide: Boronated product of phthalic monoimide having a polybutenyl group (boron amount 0.4 mass %)

(10) Sulfur-containing phosphorus compound: Di(octoxyethylthioethyl)phosphite, component (b)

(11) DBDS: di-tertiary butyldisulfide

(12) Glyceride: Monoglyceride oleate

(13) Sulfuric extreme pressure agent: Thiadiazole compound, component (c)

(14) Antifoaming Agent: silicone antifoaming agent

Evaluation Result

As shown in Table 1, since the lubricating oil composition of the exemplary embodiment (Examples 1 to 4) is provided by blending a predetermined alkaline earth metal sulfonate (the component (a)), sulfur-containing phosphorus compound (the component (b)) and thiadiazole compound (component (c)) in a base oil, and the product ((c)×P) of the mass (mass %) of the component (c) and the mass (mass ppm) of phosphorus element in the component (b) is in a range from 1 to 50, the lubricating oil composition exhibits excellent abrasion resistance and restrained copper elution properties.

In contrast, the lubricating oil compositions according to Comparatives 1 to 7 lack at least one of the above features. Accordingly, either or both of abrasion resistance and copper elution properties are inferior.

The invention claimed is:

1. A lubricating oil composition, comprising:

a base oil; and an additive comprising:

(a) at least one of an alkaline earth metal sulfonate, an alkaline earth metal salicylate and an alkaline earth metal phenate;

(b) a sulfur-containing phosphorus compound represented by formula (1):

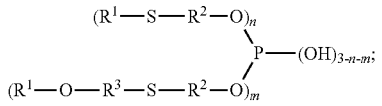

(1)

and (c) a thiadiazole compound selected from the group consisting of 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis-(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyl dithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyl dithio)-1,2,3-thiadiazole and 4,5-bis-(1,1,3,3-tetramethylbutyldithio)-1,2,3-thiadiazole, wherein:

$R^1$ independently represents a hydrocarbon group having 6 to 20 carbon atoms;

$R^2$ and $R^3$ independently represent an alkylene group having 1 to 6 carbon atoms;

n represents 0, 1 or 2;

m represents 1 or 2; and a product ((c)×P) of a mass (mass %) of component (c) and a mass (mass ppm) of a phosphorus element in component (b) in the composition ranges from 1 to 50.

2. The lubricating oil composition according to claim 1, wherein component (a) is at least one of a Ca salt and a Mg salt.

3. The lubricating oil composition according to claim 1, wherein a base number of component (a) measured by a perchloric acid method is in a range from 10 mgKOH/g to 500 mgKOH/g.

4. The lubricating oil composition according to claim 1, wherein a mass of alkaline earth metal in component (a) ranges from 200 mass ppm to 1000 mass ppm based on a total amount of the composition.

5. The lubricating oil composition according to claim 1, wherein a content of phosphorus element in the component (b) ranges from 50 mass ppm to 300 mass ppm based on the total amount of the composition.

6. The lubricating oil composition according to claim 1, wherein the lubricating oil composition is adapted to function as a lubricating oil composition for an automatic transmission.

7. The lubricating oil composition according to claim 6, wherein the automatic transmission is a continuously variable transmission.

8. The lubricating oil composition according to claim 7, wherein the continuously variable transmission is a metal-belt continuously variable transmission or a chain continuously variable transmission.

9. A method, comprising lubricating an automatic transmission with the lubricating oil composition according to claim 1.

10. The method according to claim 9, wherein the automatic transmission is a continuously variable transmission.

11. The method according to claim 10, wherein the continuously variable transmission is a metal-belt continuously variable transmission or a chain continuously variable transmission.

12. The lubricating oil composition of claim 1, wherein the product ((c)×P) of a mass (mass %) of the component (c) and a mass (mass ppm) of a phosphorus element in the component (b) in the composition ranges from 20 to 29.

* * * * *